US007073681B2

(12) United States Patent
Abe et al.

(10) Patent No.: US 7,073,681 B2
(45) Date of Patent: Jul. 11, 2006

(54) FUEL INLET STRUCTURE FOR PERSONAL WATERCRAFT

(75) Inventors: Tomohisa Abe, Saitama (JP); Yoshiaki Noda, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 23 days.

(21) Appl. No.: 10/660,107

(22) Filed: Sep. 11, 2003

(65) Prior Publication Data

US 2004/0079756 A1 Apr. 29, 2004

(30) Foreign Application Priority Data

Sep. 11, 2002 (JP) ..... 2002-266074

(51) Int. Cl.
*B65D 55/16* (2006.01)

(52) U.S. Cl. ..... 220/375; 220/754

(58) Field of Classification Search ..... 220/375, 220/754, DIG. 33, DIG. 32, 582, 4.14, 4.15; 137/588; 251/250; 285/306
See application file for complete search history.

(56) References Cited

U.S. PATENT DOCUMENTS 1,573,096 A * 2/1926 Schlaich ..... 220/288
1,762,757 A * 6/1930 Behnke ..... 220/288
1,923,338 A * 8/1933 Stant ..... 220/301
1,958,019 A * 5/1934 Reasoner ..... 70/170
3,420,585 A * 1/1969 Jensen ..... 384/189
4,118,902 A * 10/1978 Saxton ..... 52/27
4,836,835 A * 6/1989 Harris et al. ..... 96/113
4,872,587 A * 10/1989 Zimmermann et al. ..... 220/375
5,165,565 A * 11/1992 Schlessmann et al. ..... 220/304
5,320,240 A * 6/1994 Wehle et al. ..... 220/375
5,839,489 A * 11/1998 Ganachaud et al. ..... 141/382
6,050,587 A * 4/2000 Panhausen ..... 280/480
6,244,916 B1 * 6/2001 Asakura et al. ..... 440/88 R
6,592,415 B1 * 7/2003 Berthiaume ..... 440/88 A

FOREIGN PATENT DOCUMENTS

JP 2000053091 A 2/2000

* cited by examiner

*Primary Examiner*—Lien M. Ngo
(74) *Attorney, Agent, or Firm*—Carrier, Blackman & Associates, P.C.; William D. Blackman; Joseph P. Carrier

(57) ABSTRACT

A fuel inlet apparatus is provided for a personal watercraft of the type having a fuel tank 13 disposed in a craft body 11, and a fuel supply hose 81 extending from the fuel tank 13 with an end thereof connected to a fuel filler member 82 on a deck 20. One end of a chain 83 is fastened inside the fuel filler member 82, and the other end of the chain 83 is fastened to a fill cap 84 used for sealably closing the top of the fuel filler member 82. The chain 83 has a protective tube 86 surrounding a portion thereof, to contact the fuel filler 85 when the fill cap 84 is removed. The provision of the protective tube 86 reduces the risk of damage to the fuel filler or the deck, and the chain itself can also be protected by the tube.

11 Claims, 9 Drawing Sheets

PRIOR ART

FUEL INLET STRUCTURE FOR PERSONAL WATERCRAFT

CROSS-REFERENCE TO RELATED APPLICATIONS

The present application claims priority under 35 U.S.C. 119, based on Japanese patent application No. 2002-266074, filed Sep. 11, 2002.

BACKGROUND OF THE INVENTION

1. Field of the Invention

The present invention relates to a fuel inlet structure for a personal watercraft. More particularly, the present invention relates to a fuel inlet structure including a fuel fill tube, with a fuel filler cap restrained by of a chain interconnecting the fuel filler cap and the fuel fill tube, to prevent loss of the fuel filler cap or damage to the personal watercraft during fuel filling service.

2. Description of the Background Art

One fuel inlet structure for a personal watercraft is known wherein a chain is attached to a fuel fill tube, and connects the fill tube to a cap provided for closing up an open end of the fuel fill tube. For example, Japanese Laid-Open Patent No. 2000-53091 has this type of connection.

FIG. 9 of the present application is copied from FIG. 1 of the official gazette of Japanese Patent Laid-Open No. 2000-53091, for purposes of explanation of this published reference.

According to the conventional prior art fuel filler structure 100 for a personal watercraft illustrated in FIG. 9, an opening 102 is perforated in a deck 101 to receive fuel and direct it to the appropriate storage receptacle on the watercraft. A fuel fill tube 105 having a fuel filler neck 104 fits into the opening 102, with a gasket 103 interposed therebetween. A fill cap 107 is also provided for closing up the top of the fuel filler neck 104, and another gasket 108 forms a seal between the fill cap 107 and the filler neck 104.

A chain 106 extends from the fuel fill tube 105, as shown, and the chain can be attached to the fill cap 107. The known fuel filler structure 100 for a personal watercraft shown in FIG. 9 prevents of the fill cap 107 from dropping into water upon fueling, since the fill cap 107 is physically connected to the fill tube 105 by the chain 106.

With the known fuel filler structure for a personal watercraft described above, when the fill cap is suspended on the fuel fill tube by the chain, the chain sometimes impacts on the fuel fill tube or on a member around the deck and damages the fuel filler or the deck.

Further, when the chain impacts on the fuel filler or a member around the deck, the chain itself may be damaged, which shortens the life of the chain.

Although the known filler structures are useful for their intended purposes, a need still exists in the art a fuel filler structure for a personal watercraft in which the fuel filler structure can prevent damage to a fuel fill tube or a deck, and can minimize the risk that a chain will cause damage to a fill tube or to the deck of the watercraft.

SUMMARY OF THE INVENTION

In order to achieve the object described above, a fuel filler structure according to a first illustrative embodiment of the present invention is provided for a personal watercraft having a craft body including a deck, a fuel fill tube installed on the deck, and a fuel tank disposed in the craft body with a fuel hose extending from the fuel tank and having an end thereof connected to the fuel fill tube on the deck.

In the first embodiment hereof, a chain is provided for interconnecting the fuel fill tube and a filler cap or the watercraft. One end of the chain is fastened to the inside of the fuel fill tube member, and the other end of the chain is fastened to a fill cap. The fill cap is provided to sealably close up a fuel fill tube of the fuel fill tube member. Also in the first embodiment hereof, the chain includes a protective tube at a location thereof which contacts with the fuel fill tube when the fill cap is removed.

By providing a protective tube around the portion of the chain attached to the fuel filler tube, the risk of the chain causing damage to either fuel filler or a deck can be reduced, and damage to the chain itself can be minimized or prevented.

Therefore, the chain includes the protective tube at the location thereof where the chain contacts the fuel filler when the fill cap is removed, so that damage to the fuel filler or the deck is substantially prevented and the chain itself also protected. As a result, fuel can be supplied without paying unnecessarily high attention to the fuel filler or to the deck, and improvement in workability of the fueling operation can be anticipated.

According a second illustrative embodiment of the present invention, the chain includes a stopper thereon, for stopping movement of the protective tube up the chain.

Since the stopper for stopping movement of the protective tube is provided on the chain, the protective tube is retained at a necessary location on the chain. As a result, the protective tube can be partially attached to a location on the chain for which protection is required, and the effectiveness of protective tube can be maximized.

Optionally, the stopper may be provided in the form of a bead integrally provided on the chain. Where the stopper is a bead integrally provided on the chain, correct placement of the protective tube on the chain can be attained, for example, by simply sliding the protective tube onto the chain and attaching the fill cap to the end of the chain. As a result, improvement in installing the protective tube can be realized.

Alternatively, the stopper may be provided in the form of a slit washer which can be attached to the chain subsequent to initial assembly. Where the stopper is formed as a slit washer which can be attached to the chain subsequent to initial assembly, it is possible, for example, to slide a plurality of protective tubes onto the chain, and attach the protective tubes at an arbitrary position of the chain with a slit washer later. As a result, expansion of the utility of the protective tube can be realized.

DETAILED DESCRIPTION

Figure 1:
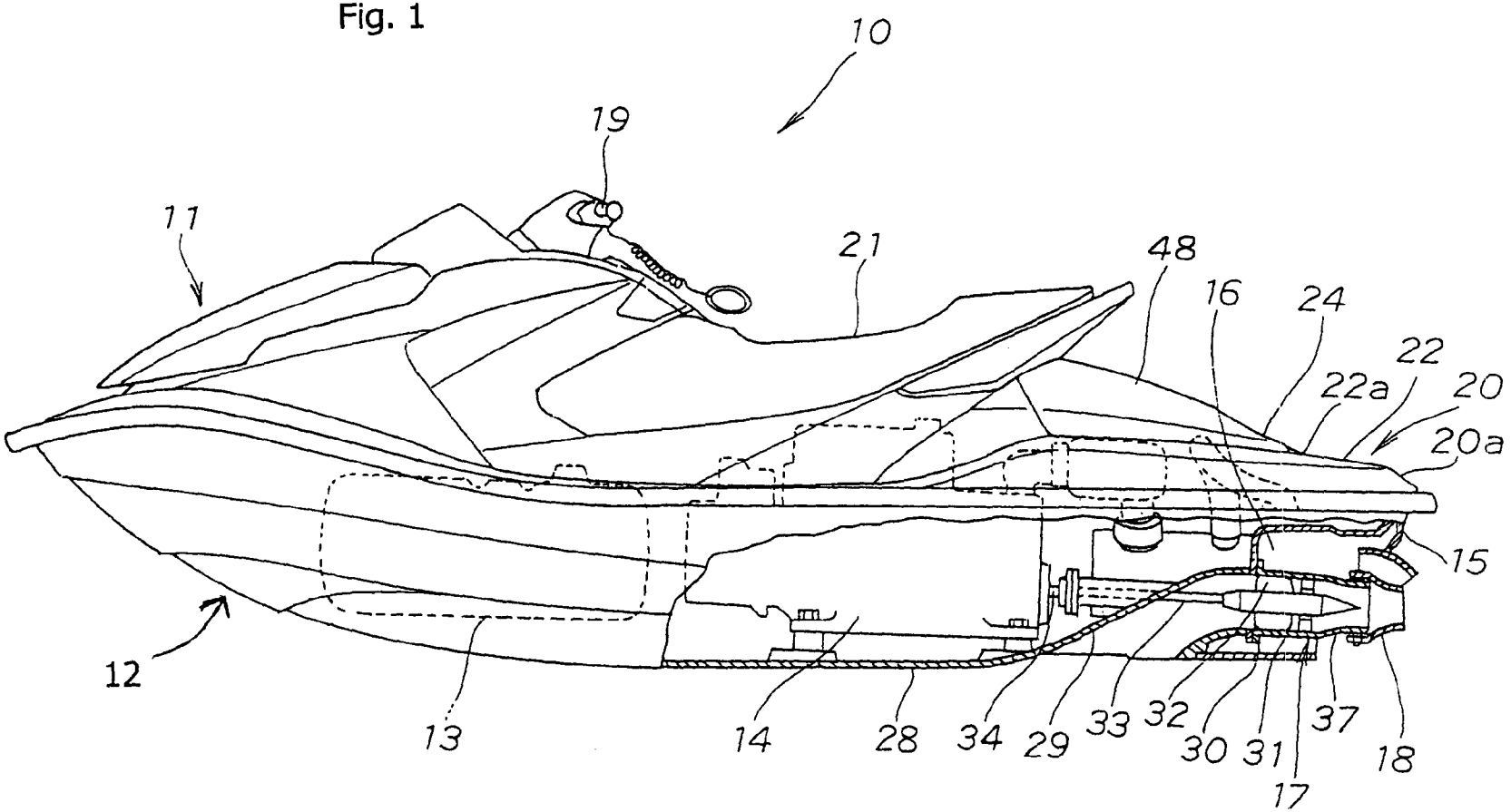
FIG. 1 is a side elevational view of a personal watercraft including a fuel filler structure according to a first illustrative embodiment of the present invention.

In the following, embodiments of the present invention are described with reference to the accompanying drawings. Here, the terms "front", "rear", "left" and "right" represent directions as viewed from the vantage point of a driver. It is to be noted that the drawings should be viewed in the direction of reference characters.

FIG. 1 is a side elevational view of a personal watercraft 10 including a fuel filler structure according to a first illustrative embodiment of the present invention.

The personal watercraft 10 includes a craft body 11, including a hull 12 and a deck 20 attached to the top of the hull. The craft body 11 has a fuel tank 13 provided therein at a front portion thereof An engine 14 is provided in the hull 12 in back of the fuel tank 13. A jet propeller chamber 16 is provided behind the engine 14, at a stem 15 of the craft body. A water jet propeller 17 is provided in the jet propeller chamber 16. A steering nozzle 18 is pivotally attached to the back end of the water jet propeller 17.

A steering handle member 19, for remotely operating the steering nozzle 18, is provided above the fuel tank 13. A seat 21 is provided on the deck 20, behind of the steering handle member 19, such that it extends forwardly and rearwardly. A rear platform 22 is provided behind the seat 21, such that it extends substantially and horizontally forward from a rear end portion 20*a* of the deck 20. An inclined face portion 24 having an upward slope is provided such that it extends toward the seat 21 from a front end center (front end) 22*a* of the rear platform 22. A rear cover 48 is provided between the seat 21 and the rear platform 22.

The water jet propeller 17 has an inlet port 29 formed in a craft bottom 28 of the hull 12. The inlet port 29 extends to the jet propeller chamber 16. A cylindrical stator 31 is provided on a wall portion (stator plate) 30 of the jet propeller chamber 16. An impeller 32 is disposed in the stator 31 and is supported for rotation thereof. A drive shaft 34 is connected to a shaft 33 of the impeller 32.

The front end of the drive shaft 34 is connected to the engine 14 for outputting driving power of the engine 14.

With the personal watercraft 10, the impeller 32 can be rotated through the shaft 33, by rotating the drive shaft 34 by means of the engine 14. When the impeller 32 rotates, water can be taken in through the inlet port 29 and introduced into the stator 31.

The thus introduced water can be introduced to the steering nozzle 18 through a jet nozzle 37 at a rear end of the stator 31, and then jetted rearwardly as a waterjet from the rear end of the steering nozzle 18. The jet water can be utilized to propel the personal watercraft 10 forward on a water surface.

Figure 2:
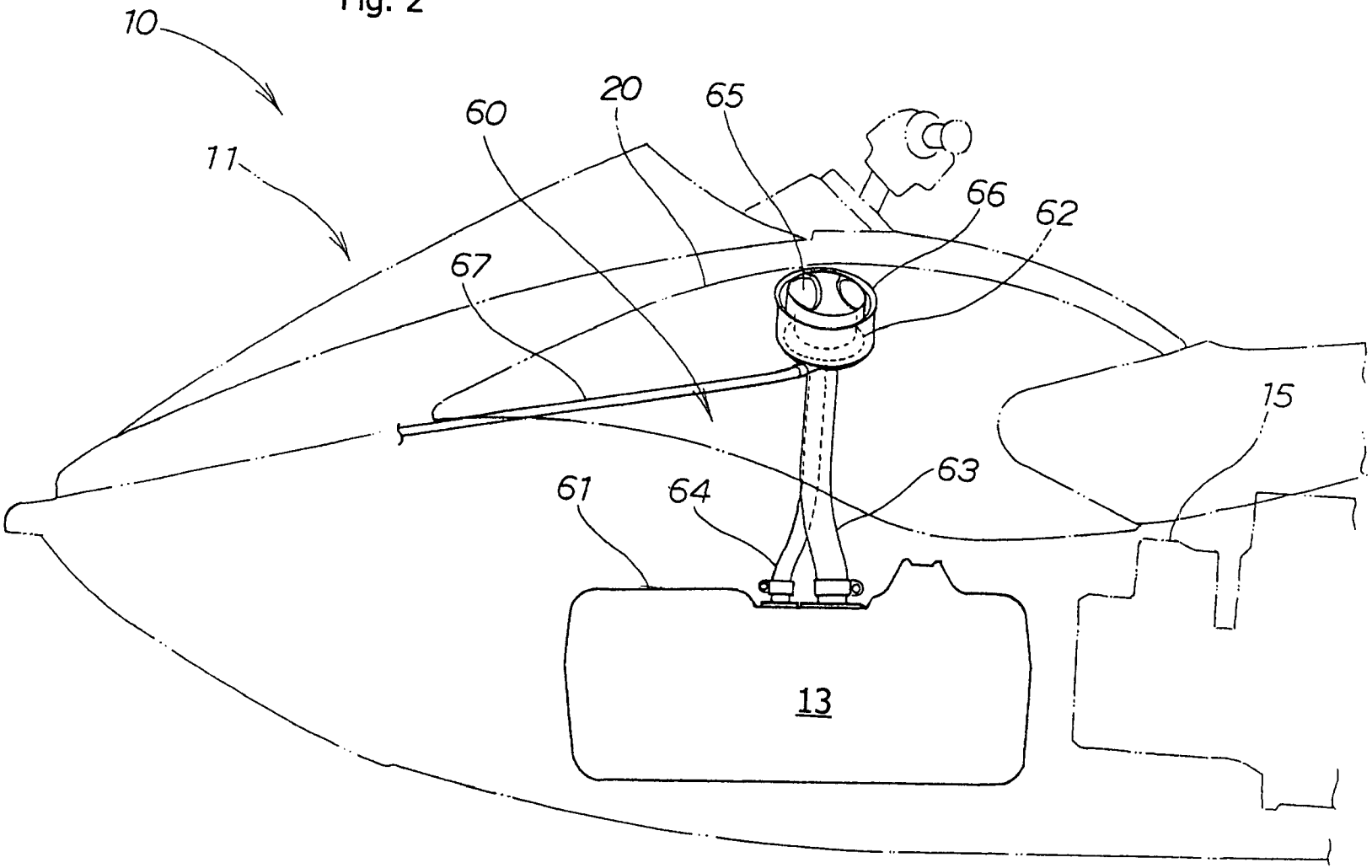
FIG. 2 is a side elevational view of a fuel filler structure for a personal watercraft according to the first embodiment, also showing selected components of the watercraft in phantom.

FIG. 2 is a side elevational view of a fuel filler structure 60 according to a first illustrative embodiment hereof, also showing selected components of the watercraft in phantom.

The fuel filler structure 60 is provided for use as one part of the personal watercraft 10, including the fuel tank 13 for reserving fuel, a fuel fill neck 62 attached to the deck 20 for pouring fuel therethrough, a fuel supply hose 63 for connecting the fuel tank 13 and the fuel fill neck 62 to each other, and a bleed hose 64 for keeping the tank pressure in the fuel tank 13 fixed.

The fuel filler structure 60 also includes a fill cap 65 for closing up the fuel fill neck 62, a cup 66 for collectively covering the fill cap 65 and the fuel fill neck 62, a drain hose 67 for draining water from the bottom of the cup 66, and a chain 68 (refer to FIGS. 3–4) for connecting the fuel fill neck 62 and the fill cap 65 to each other, and for preventing the fill cap 65 from dropping into the water around the watercraft 10.

Figure 3:
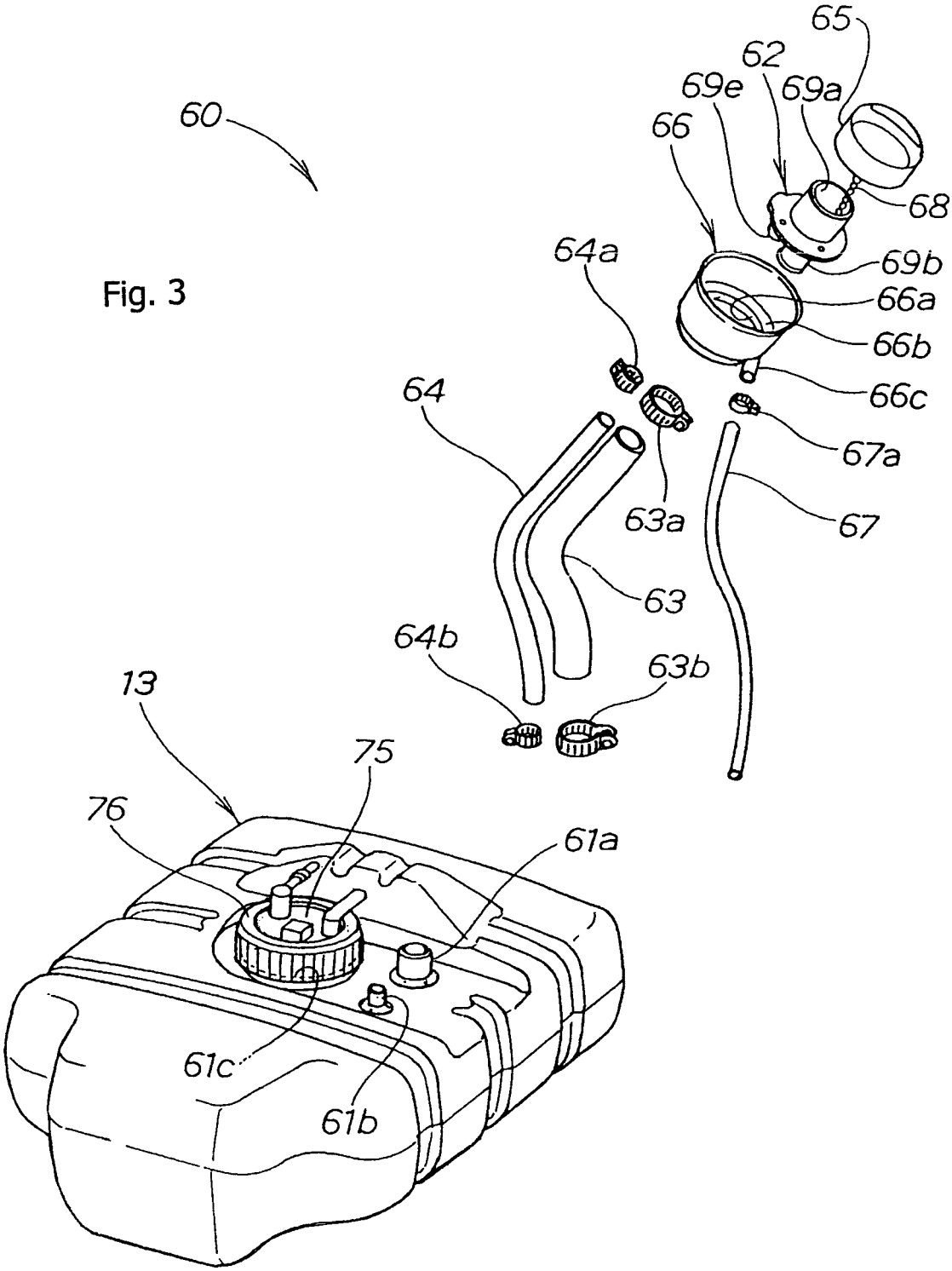
FIG. 3 is an exploded perspective view of the fuel filler structure of FIG. 2.

FIG. 3 is an exploded perspective view of the fuel filler structure for a personal watercraft according to the first embodiment, and shows major parts of the fuel filler structure 60.

The fuel tank 13 is a tank formed from a fuel tolerant plastic resin, and includes an upper surface 61 (FIG. 2) with an inlet port 61*a* to which the fuel supply hose 63 is connected, and a connecting port 61*b* to which the bleed hose 64 is connected. A fuel pump 75 is provided inserted in an opening 61*c* formed in the upper surface 61 of the fuel tank 13, and a securing ring 76 is provided surrounding the opening 61*c*, for securing the fuel pump 75 therein.

A first hose band 63*a* is provided for securing an upper end of the fuel supply hose 63 around the bottom of the fuel fill neck 62, as well a second hose band 63*b* for securing the lower end of the fuel supply hose 63 to the inlet port 61*a*.

A third hose band 64*a* is provided for securing an upper end of the bleed hose 64 to the fuel fill neck 62, and a fourth hose band 64*b* is provided for securing the lower end of the bleed hose 64 to the connecting port 61*b*.

The cup 66 has an opening portion 66*a* formed therein for allowing a lower portion of the fuel fill neck 62 to extend therethrough. The cup 66 also has a flange portion 66*b* extending inwardly at the bottom thereof and surrounding the opening portion 66*a*, for allowing the cup to be fastened to the deck 20 (refer to FIG. 1) together with the fuel fill neck 62. The cup 66 also includes a drain port 66*c* extending outwardly thereon, as shown, for allowing water to be drained therethrough.

The drain hose 67 is provided with a fifth hose band 67*a* for securing the drain hose 67 to the drain port 66*c*.

Figure 4:
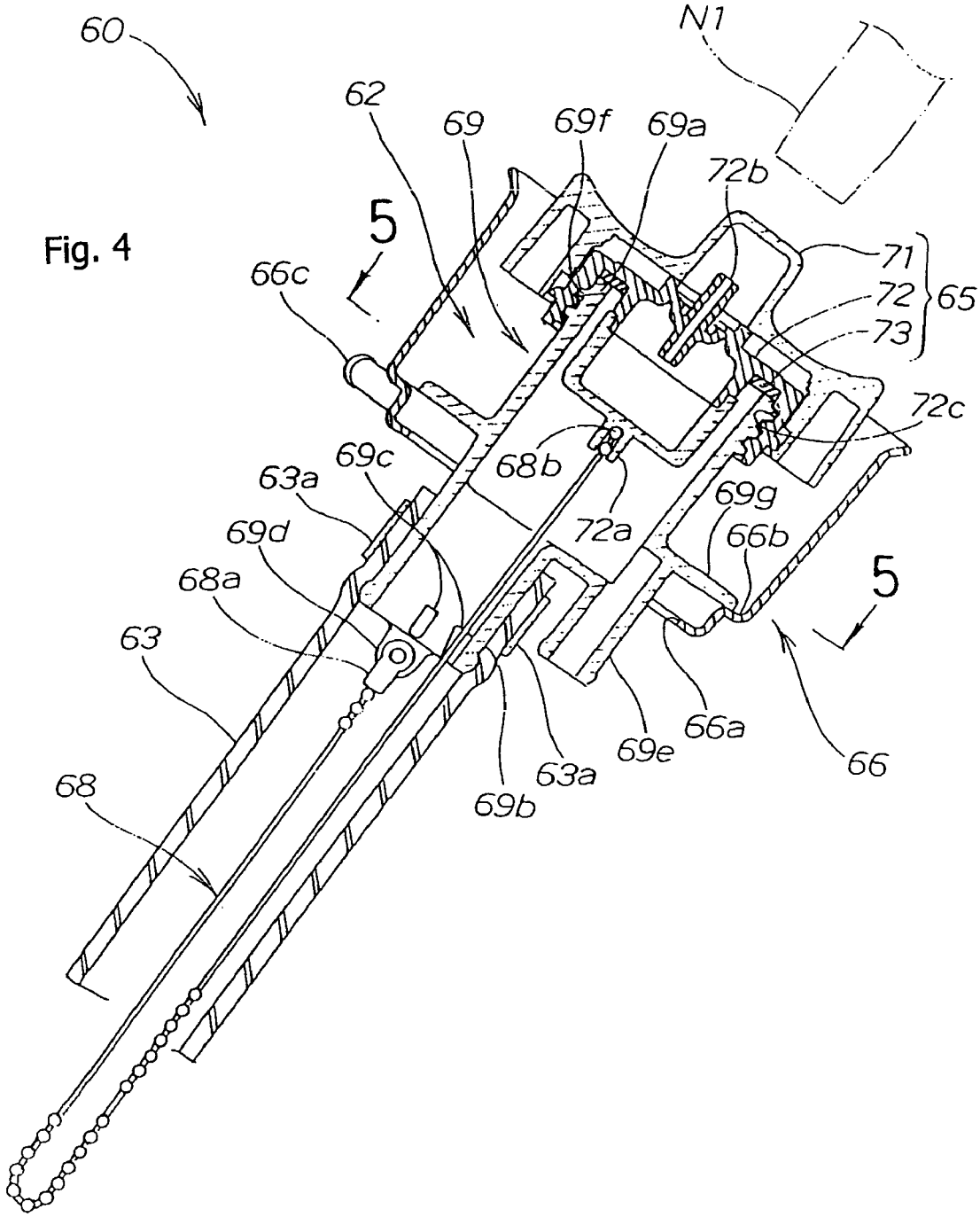
FIG. 4 is a cross-sectional view of the fuel filler structure of FIGS. 2–3.

FIG. 4 is a cross-sectional view of the fuel filler structure of FIGS. 2–3.

The fuel fill neck 62 includes a tubular routing structure 69 having a fuel filler 69*a* formed at an end thereof, to which the fill cap 65 is to be attached. The fuel fill neck 62 also includes a hose connecting portion 69*b* at the bottom thereof, to which the fuel supply hose 63 is to be connected.

The hollow passage within the routing structure 69 has a plurality of projections 69*c* formed intermediately therein, for positioning an end of a fueling nozzle N1 (shown in phantom in FIG. 4). Each of the projections 69*c* provides stop member, disposed within the tubular routing structure, for limiting the extent to which a fuel nozzle can be inserted therein. The fuel fill neck 62 further has a fastening tab 69*d* extending downwardly from the connecting portion 69*b* below the projections 69*c*, such that an end 68*a* of the chain 68 is to be fastened thereto. The fuel fill neck 62 further has a bleed hose connecting portion 69*e* branched intermediately therefrom, so that the bleed hose 64 maybe connected thereto.

The fuel fill neck 62 further has a male threaded portion 69*f* formed at an upper end thereof, such that the fill cap 65 may be screwed thereon. The fuel fill neck 62 further has a transverse flange portion 69*g* formed thereon for fastening the cup 66 and the fuel fill neck 62 together to the deck 20 of the craft body 11 (refer to FIG. 1), using screws, bolts, rivets or other suitable fasteners (not shown).

The fill cap 65 includes an outer cap 71, an inner cap 72 integrally attached to the outer cap 71, and an annular gasket 73 attached to an inner surface of the inner cap 72.

The inner cap 72 includes an attaching portion 72*a* to which the upper end 68*b* of the chain 68 is to be attached, a bleed hole 72*b* for keeping the pressure in the fuel tank 13 equal to the atmospheric pressure, and a female threaded portion 72*c* for receiving the male threaded portion 69*f* of the fuel fill neck 62, when the fill cap 65 is screwed onto the fuel filler 69*a*.

The fuel filler structure 60 for a personal watercraft hereof includes the chain 68, to prevent a user from accidentally dropping the fill cap 65 into water around the watercraft. One end of the chain 68 is connected to the fill cap, while the other end 68*a* of the chain 68 is connected to the fuel fill neck 62 at a portion thereof below the projections 69*c*.

Since the end 68*a* of the chain 68 is connected to the fuel fill neck 62 below the projections 69*c*, upon fueling, the fueling nozzle N1 does not contact the end 68*a* of the chain 68 at all. As a result, interference with the fastening portion 69*d* of the fuel fill neck 62, to which the end 68*a* of the chain 68 is connected, can be prevented.

In particular, in the embodiment shown in the drawings, the fuel filler structure 60 for a personal watercraft hereof is configured such that the fuel tank 13 is disposed in the craft body 11, and the fuel fill neck 62 is provided in the deck 20, while the fuel tank 13 and the fuel fill neck 62 are connected to each other by the fuel supply hose 63. The fuel fill neck 62 is closed up with the fill cap 65, the fuel fill neck 62 includes the tubular routing structure 69 which has the fuel filler 69*a* formed at one end thereof. The hose connecting portion 69*b* is formed at the other end of the fill neck 62, and the restricting projections 69*c*, for positioning the end of the fueling nozzle N1, are formed intermediately in the routing structure 69.

Figure 5:
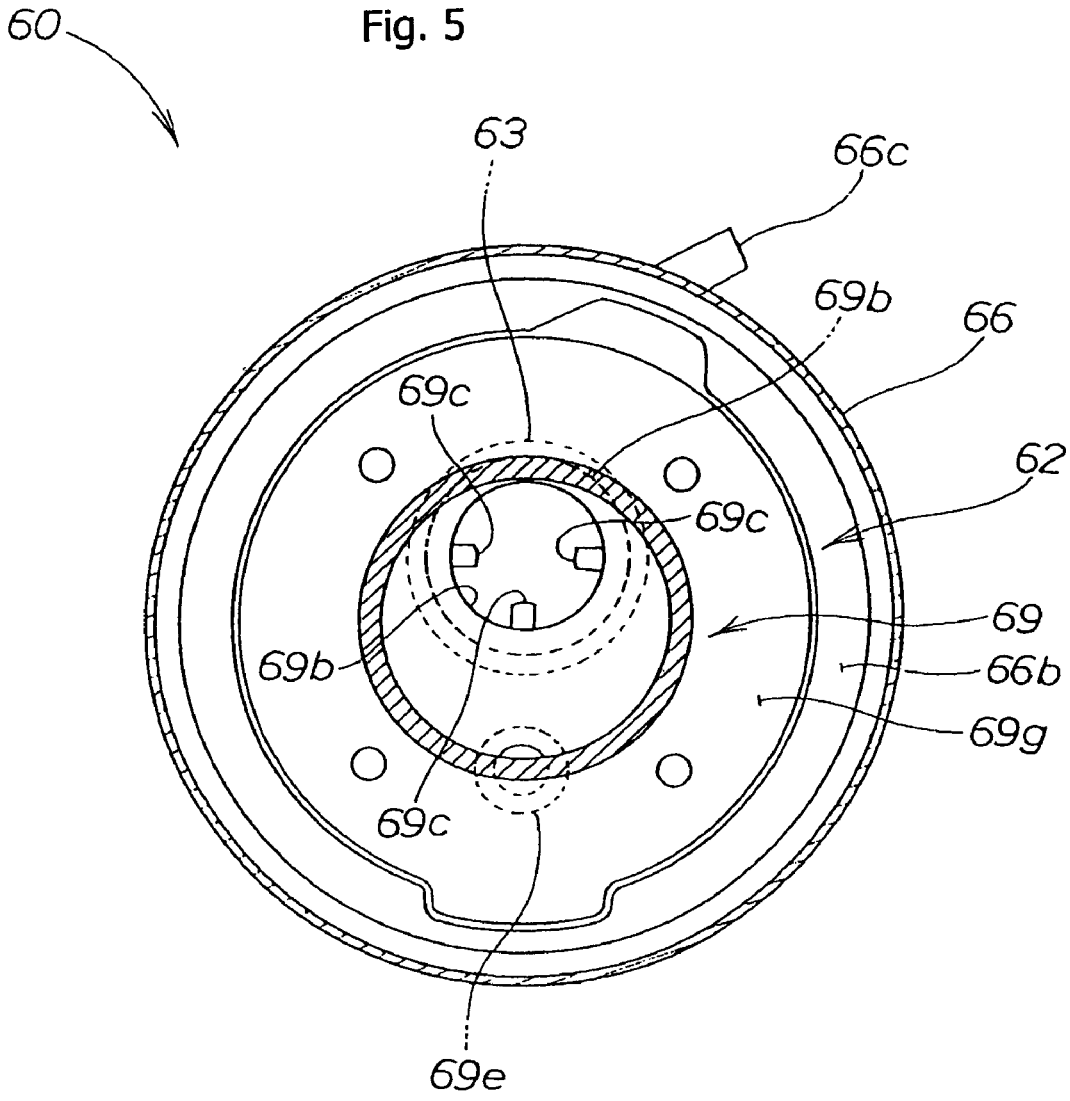
FIG. 5 is a sectional view taken along line 5—5 of FIG. 4.

FIG. 5 is a sectional view of the fuel filler for a personal watercraft according to the selected embodiment, taken along line 5—5 of FIG. 4.

The fuel filler structure 60 for a personal watercraft includes the tubular routing structure 69 provided in the fuel fill neck 62. The routing structure 60 has the fuel filler 69*a* (refer to FIG. 4) formed at one end thereof, and has the hose connecting portion 69*b* formed at the other end thereof. Further, the projections 69*c* for positioning the end of the fueling nozzle N1 (refer to FIG. 4) for supplying fuel therethrough are formed intermediately in the passage within the routing structure 69. Therefore, the fueling nozzle N1 can be prevented from unnecessarily entering the fuel supply hose 63 or the fuel tank 13 (refer to FIG. 3).

As a result, the fueling nozzle N1 can be prevented from hitting the fuel supply hose 63 or the fuel tank 13. Further, it is shown that the projections 69*c* may include three projections projecting from the routing structure 69.

Action of the fuel filler structure 60 for a personal watercraft described above is explained below.

Figures 6A, 6B, 6C:
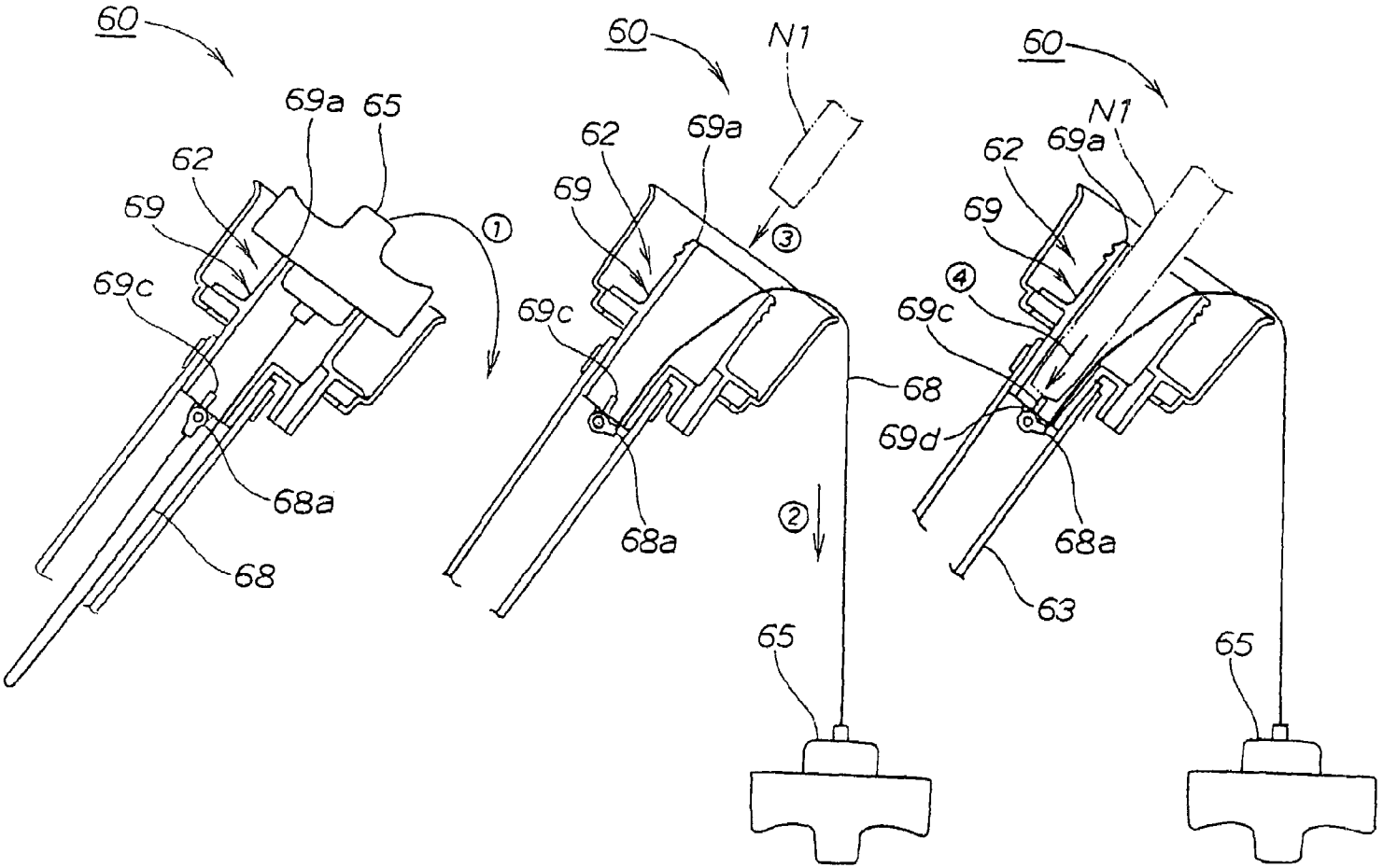
FIGS. 6(*a*)–(*c*) show a series of sequential sectional views of the fuel filler structure of FIGS. 2–3, illustrating use thereof during a filing operation.

FIGS. 6(*a*)–(*c*) show a series of sequential sectional views of the fuel filler structure of FIGS. 2–3, illustrating use thereof during a filing operation.

In FIG. 6(*a*), the fill cap 65 is removed from the fuel filler 69*a* as indicated by an arrow mark (1)↑.

In FIG. 6(*b*), since the fill cap 65 can be suspended as indicated by an arrow mark (2)↑ by the chain 68, there is no possibility that the fill cap 65 may drop into water. Thereafter, the fueling nozzle N1 is inserted into the fuel filler 69*a* as indicated by an arrow mark (3)↑.

In FIG. 6(*c*), the end of the fueling nozzle N1 is brought into abutment with the projections 69*c* of the routing structure 69 as indicated by an arrow mark (4)↑. In other words, the fueling nozzle N1 can be prevented from unnecessarily entering the fuel supply hose 63 or the fuel tank 13 (refer to FIG. 3).

Further, since one end 68*a* of the chain 68 is connected to the fuel fill neck 62 at a position lower than the projections 69*c*, the fueling nozzle N1 does not hit the end 68*a* of the chain 68. As a result, interference with the fastening portion 69*d* of the fuel fill neck 62, to which the end 68*a* of the chain 68 is connected, can be prevented.

Figure 7:
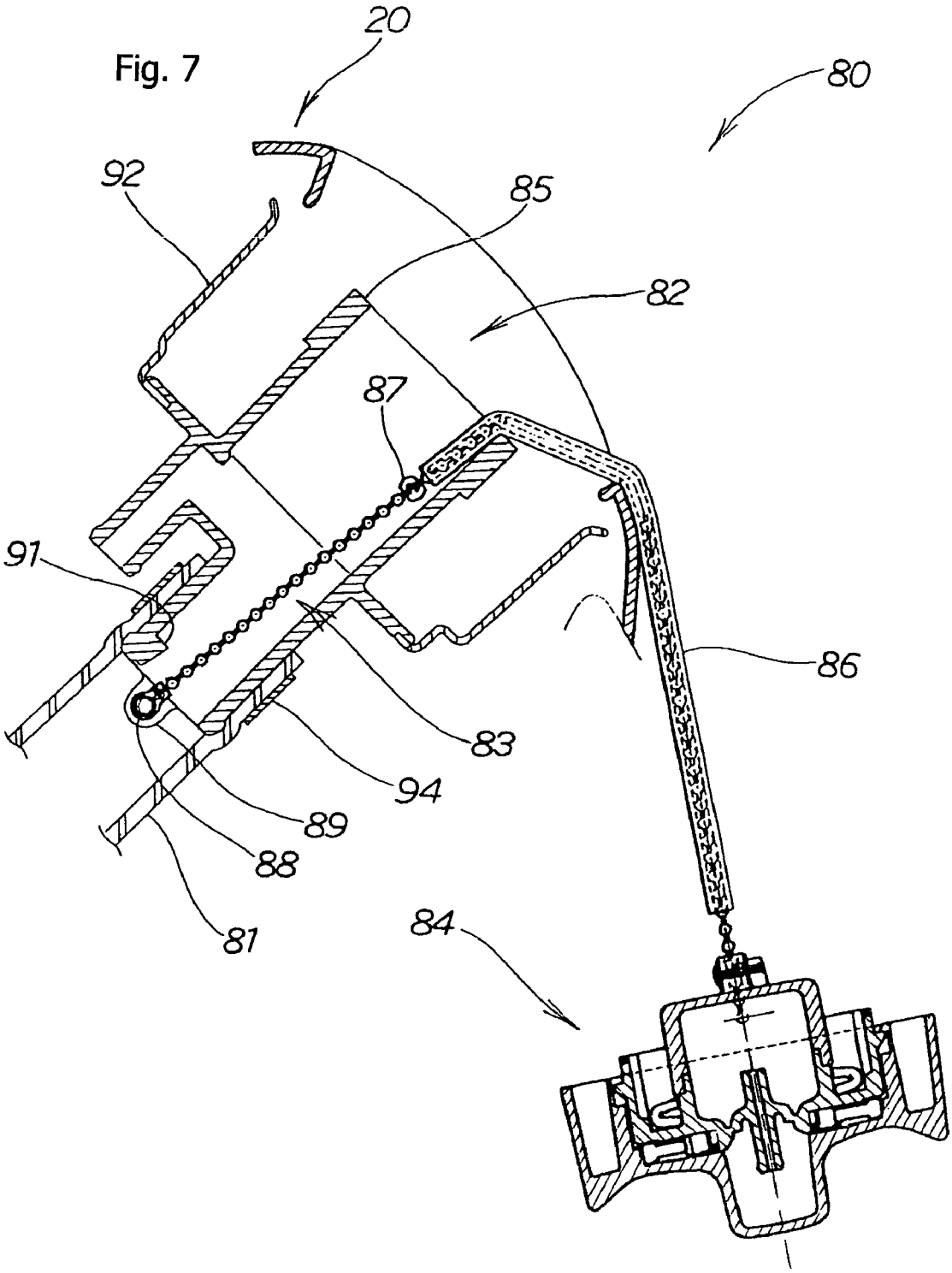
FIG. 7 is a front elevation sectional view of a fuel filler structure for a personal watercraft according to a second embodiment of the present invention.

FIG. 7 is a front elevation sectional view of a fuel filler structure 80 for a personal watercraft according to a second embodiment of the present invention. Parts of the structure 80 which are substantially identical to those used in the first embodiment of a fuel filler structure 60 for a personal watercraft (refer to FIG. 3) are denoted by like reference characters, and detailed description thereof is omitted. It will be understood that components of the structure 80 which are not specifically described as being different from the structure 60 are substantially identical to those described in connection with the first embodiment.

The fuel filler structure 80 for a personal watercraft, according to the second embodiment, is configured such that in a fuel filler structure for a small size craft of the type wherein a fuel tank 13 is disposed in a craft body 11 (FIG. 1) and a fuel supply hose 81 extends from the fuel tank 13 with an end thereof connected to a fuel filler member 82 on a deck 20 while one end of a chain 83 is fastened to the inside of the fuel filler member 82 and the other end of the chain 83 is connected to a fill cap 84, the chain 83 includes a protective tube 86 as a sleeve surrounding the chain 83, at a location where the chain 83 contacts the fuel filler 85 when the fill cap 84 is removed.

In FIG. 7, reference numeral 87 denotes a bead attached to an intermediate portion of the chain 83. The bead 87 serves as a stopper for stopping movement of the protective tube 86. A washer 88 is attached to an end of the chain 83, for connecting the chain to a fastening portion 89 formed on the fill tube.

Also in the embodiment of FIG. 7, a projection 91 is formed on the inside of the fuel filler member 82 for limiting the entry distance of the fueling nozzle Ni, and a hose band 94 is provided for clamping the supply hose 81 to the lower end of the fuel filler member 82. The projection 91 provides a stop member, disposed within the tubular routing structure, for limiting the extent to which a fuel nozzle can be inserted therein.

It is preferable if, for example, damage to a fuel filler or a deck can be prevented and a chain itself can be prevented from causing damage thereto.

Therefore, the chain 83 includes the protective tube 86 at the location thereof at which the chain 83 is to contact the fuel filler 85 when the fill cap 84 is removed, so that damage to the fuel filler 85 or the deck 20 is prevented, and the chain 83 itself is prevented from causing damage thereto. As a result, fuel can be supplied without paying unnecessarily high attention to the fuel filler 85 or the deck 20, and improvement in workability of the fueling operation can be anticipated.

Further, the fuel filler structure 80 for a personal watercraft is characterized in that the chain 83 includes a stopper for stopping movement of the protective tube 86.

Since the stopper (bead) 87 for stopping movement of the protective tube 86 is provided on the chain 83, the protective tube 86 can be retained at a necessary location of the chain 83. As a result, the protective tube 86 can be partially attached to a location of the chain 83 for which protection is required, and achievement of effective utilization of the protective tube 86 can be anticipated.

Furthermore, where the stopper 87 is a bead integrally provided on the chain, movement of the protective tube 86 on the chain 83 can be stopped, for example, only by threading the protective tube 86 onto the chain 83 and attaching the fill cap 84 to the chain 83. As a result, improvement in assembling property of the protective tube 86 can be anticipated.

Figure 8A:
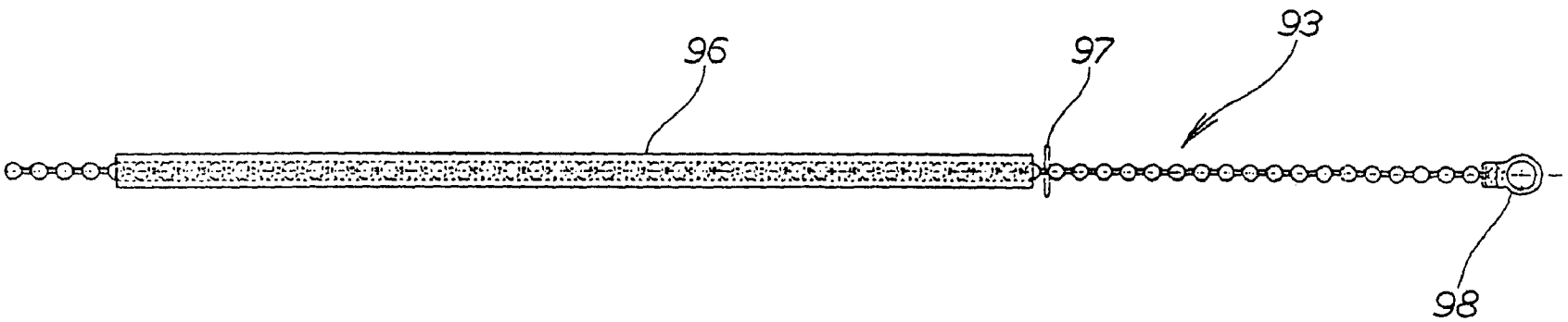
FIG. 8 shows a chain which is one component of the fuel filler structure according to the second embodiment of the present invention.
Figure 8B:
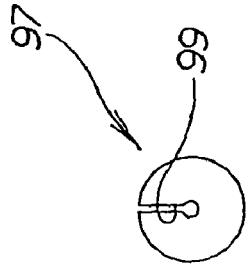
Figure 9:
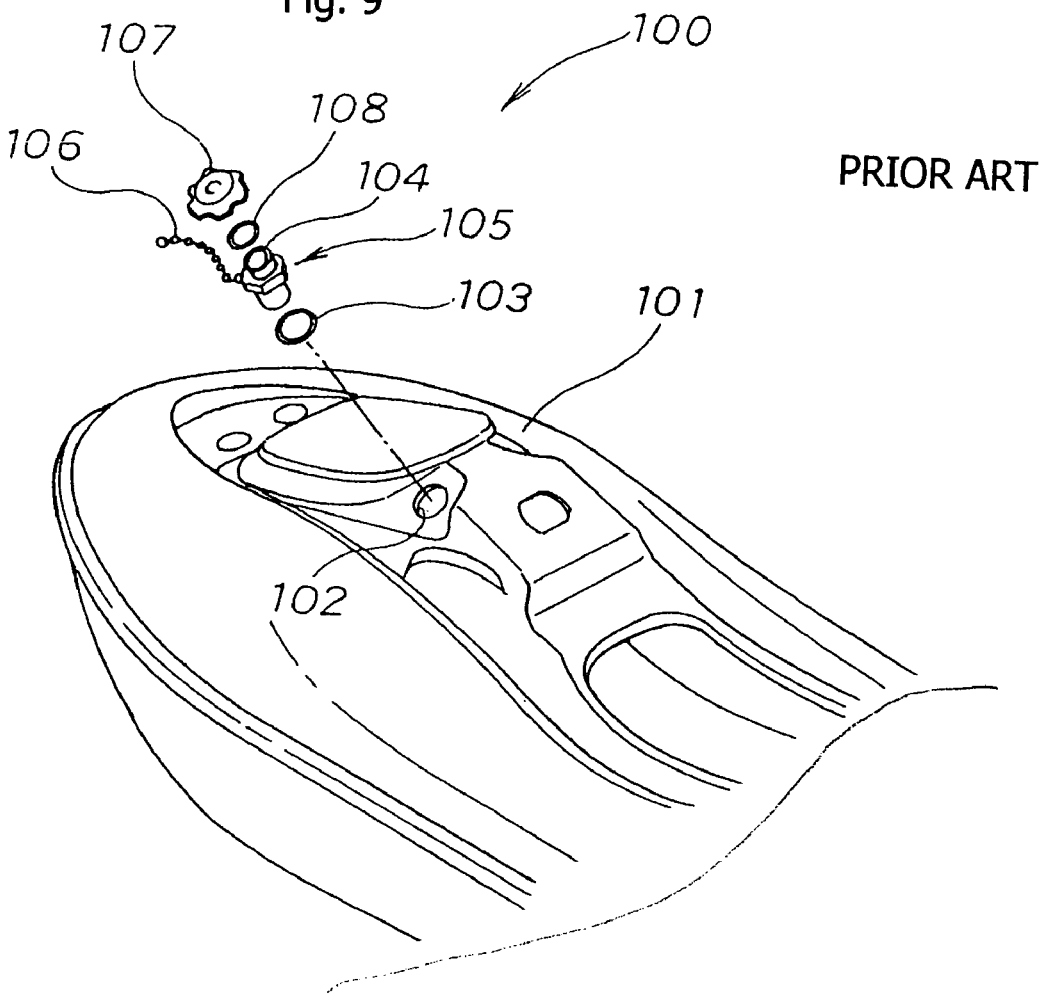
FIG. 9 is a partial reproduction of FIG. 1 of Japanese Laid-Open Patent No. 2000-53091.

FIGS. 8(*a*) and (*b*) are different form schematic views of the chain of a fuel filler structure for a personal watercraft of the second embodiment according to the present invention. (*a*) of FIG. 8 shows the front of a chain 93 of the different form, and (*b*) of FIG. 8 shows the front of a stopper 97.

Referring to of FIGS. 8(*a*) and (*b*), the chain 93 includes a slit washer as the stopper 97 and allows a protective tube 96 to be fastened to the chain 93 later. In (*a*) and (*b*) of FIG. 8, reference numeral 98 denotes a washer attached to an end of the chain 93, and 99 a slit portion of the stopper 97.

Where the stopper 97 is formed as a slit washer that can be attached to the chain 93 later, it is possible, for example, to thread a plurality of protective tubes onto the chain 93 and attach the protective tubes 96 at an arbitrary position of the chain 93 with a slit washer later. As a result, expansion of the utility of the protective tube 96 can be anticipated.

It is to be noted that, in the embodiment, the projections 69*c* are three projections projecting from the routing structure 69 as shown in FIG. 6. However, the arrangement of the projections 69*c* is not limited to this, and any number of projections of any shape may be used. For example, the projections may alternatively be pins or bars that extend diametrically in the path.

Further, in the embodiment, the single protective tube 86 is fitted on the chain 83 as shown in FIG. 7. However, the arrangement is not limited to this, and the number of stoppers may be increased to fit a plurality of protective tubes on the chain.

The present invention exhibits the following effects due to the configuration described above.

According to the first aspect of the invention, the chain includes the protective tube at the location thereof at which the chain is to contact with the fuel filler when the fill cap is removed. Consequently, damage to the fuel filler or the deck can be prevented and the chain itself can be prevented from causing damage thereto. As a result, fuel can be supplied without paying unnecessarily high attention to the fuel filler or the deck, and improvement in workability of the fueling operation can be anticipated.

According to the second aspect of the invention, since the stopper for stopping movement of the protective tube is provided on the chain, the protective tube is retained at a necessary location of the chain. As a result, the protective tube can be partially attached to a location of the chain for which protection is required, and achievement of effective utilization of the protective tube can be anticipated.

According to the third aspect of the invention, since the stopper is a bead integrally provided on the chain, movement of the protective tube on the chain can be stopped, fur example, only by threading the protective tube onto the chain and attaching the fill cap to the chain. As a result, improvement in assembling property of the protective tube can be anticipated.

According to the fourth aspect of the invention since the stopper is formed as a slit washer that can be attached to the chain later, it is possible, for example, to thread a plurality of protective tubes onto the chain and attach the protective tubes at an arbitrary position of the chain with a slit washer later. As a result, expansion of the utility of the protective tube can be anticipated.

Although the present invention has been described herein with respect to a limited number of presently preferred embodiments, the foregoing description is intended to be illustrative, and not restrictive. Those skilled in the art will realize that many modifications of the preferred embodiment could be made which would be operable. All such modifications, which are within the scope of the claims, are intended to be within the scope and spirit of the present invention.

What is claimed is:

1. A fuel inlet apparatus for a personal watercraft, the personal watercraft comprising a craft body, the craft body comprising a deck and with a fuel tank disposed in the craft body, said fuel inlet apparatus comprising:

a fuel fill member for attaching to said deck and for connecting to a fuel supply hose extending from said fuel tank, said fuel fill member comprising a tubular routing structure;

a fill cap for closing off an outer end of said fuel fill member;

a chain having one end thereof fastened to the inside of said tubular routing structure, and the other end of said chain being fastened to said fill cap; and a protective tube surrounding a portion of said chain at a location thereof which contacts said fuel fill member when said fill cap is removed, wherein said tubular routing structure comprises a fuel filling portion formed at said outer end, and comprises plural hose connecting portions at an end opposed to said outer end, each of the plural hose connecting portions extending in parallel to the tubular routing structure and opening directly thereinto, and wherein the protective tube is maintained in a desired position on said chain by means of a tube stop member.

2. A fuel inlet apparatus for a personal watercraft, the personal watercraft comprising a craft body, the craft body comprising a deck and with a fuel tank disposed in the craft body, said fuel inlet apparatus comprising:

a fuel fill member for attaching to said deck and for connecting to a fuel supply hose extending from said fuel tank, said fuel fill member comprising a tubular routing structure;

a fill cap for closing off an outer end of said fuel fill member;

a chain having one end thereof fastened to the inside of said tubular routing structure, and the other end of said chain being fastened to said fill cap;

a protective tube surrounding a portion of said chain at a location thereof which contacts said fuel fill member when said fill cap is removed; and further comprising a tube stopper attached to said chain, for limiting movement of said protective tube on said chain.

3. A fuel inlet apparatus for a personal watercraft according to claim 2, wherein said tube stopper comprises a bead attached to said chain.

4. A fuel for a personal watercraft according to claim 2, wherein said tube stopper comprises a slit washer attached to said chain.

5. A fuel inlet apparatus according to claim 1, further comprising at least one stop member disposed within said tubular routing structure for limiting the extent to which a fuel nozzle can be inserted therein.

6. A fuel inlet apparatus according to claim 2, further comprising at least one stop member disposed within said tubular routing structure for limiting the extent to which a fuel nozzle can be inserted therein.

7. A fuel inlet apparatus for a personal watercraft, the personal watercraft comprising a craft body, the craft body comprising a deck and with a fuel tank disposed in the craft body, said fuel inlet apparatus comprising:

a fuel fill member for attaching to said deck and for connecting to a fuel supply hose extending from said fuel tank, said fuel fill member comprising a tubular routing structure;

at least one stop member disposed within said tubular routing structure for limiting the extent to which a fuel nozzle can be inserted therein;

a fill cap for closing off an outer end of said fuel fill member;

a chain having one end thereof fastened to the inside of said tubular routing structure, and the other end of said chain being fastened to said fill cap; and a protective tube surrounding a portion of said chain at a location thereof which contacts said fuel fill member when said fill cap is removed, the protective tube being physically separate and spaced apart from fastening structures for the chain, wherein said tubular routing structure comprises plural hose connecting portions at an end opposed to said outer end, the fuel inlet apparatus further comprising a tube stopper attached to said chain, for limiting movement of said protective tube on said chain.

8. A fuel inlet apparatus for a personal watercraft according to claim 2, wherein said tube stopper comprises a bead attached to said chain.

9. A fuel inlet apparatus for a personal watercraft according to claim 2, wherein said tube stopper comprises a slit washer attached to said chain.

10. In a personal watercraft, the personal watercraft comprising a craft body, the craft body comprising a deck and with a fuel tank disposed in the craft body, the improvement comprising a fuel inlet apparatus, the fuel inlet apparatus comprising:

a fuel fill member for attaching to said deck and for connecting to a fuel supply hose extending from said fuel tank, said fuel fill member comprising a tubular routing structure;

a fuel supply hose attached to the fuel fill member;

a fill cap for closing off an outer end of said fuel fill member;

a chain having one end thereof fastened to the inside of said tubular routing structure, and the other end of said chain being fastened to said fill cap; and a protective tube surrounding a portion of said chain at a location thereof which contacts said fuel fill member when said fill cap is removed, wherein the protective tube is maintained in a desired position on said chain by means of a tube stop member.

11. In a personal watercraft, the personal watercraft comprising a craft body, the craft body comprising a deck and with a fuel tank disposed in the craft body, the improvement comprising a fuel inlet apparatus, the fuel inlet apparatus comprising:

a fuel fill member for attaching to said deck and for connecting to a fuel supply hose extending from said fuel tank, said fuel fill member comprising a tubular routing structure;

a fill cap for closing off an outer end of said fuel fill member;

a chain having one end thereof fastened to the inside of said tubular routing structure, and the other end of said chain being fastened to said fill cap;

a protective tube surrounding a portion of said chain at a location thereof which contacts said fuel fill member when said fill cap is removed; and a tube stopper attached to said chain, for limiting movement of said protective tube on said chain.

* * * * *